US006826286B1

(12) United States Patent
Arndt et al.

(10) Patent No.: US 6,826,286 B1
(45) Date of Patent: Nov. 30, 2004

(54) AUDIO AMPLIFICATION DEVICE WITH VOLUME CONTROL

(75) Inventors: Horst Arndt, Kitchener (CA); Andre Vonlanthen, Waterloo (CA)

(73) Assignee: Unitron Hearing Ltd., Kitchener (CA)

( * ) Notice: Subject to any disclaimer, the term of this patent is extended or adjusted under 35 U.S.C. 154(b) by 0 days.

(21) Appl. No.: 10/670,260

(22) Filed: Sep. 26, 2003

(51) Int. Cl.[7] ..... H04R 25/00
(52) U.S. Cl. ..... 381/312; 381/321
(58) Field of Search ..... 381/23.1, 312, 381/321, 104, 105, 106, 107, 109

(56) References Cited

U.S. PATENT DOCUMENTS 5,903,655 A * 5/1999 Salmi et al. ..... 381/321

6,731,768 B1 * 5/2004 Delage ..... 381/312

* cited by examiner

*Primary Examiner*—Huyen D. Le
(74) *Attorney, Agent, or Firm*—Bereskin & Parr

(57) ABSTRACT

An audio amplification device such as a hearing aid equipped with a user-operable volume control that provides users with the facility to return the volume of the device to a specific level after having been adjusted to a different level by the user. The device includes an electronic module adapted to detect when the volume control reaches a pre-determined volume reserve position from a second volume position, and to emit a reference signal when the volume reserve position is reached. The reference signal may be an audible tone, or another type of distinct signal. The present invention may be adapted for use with binaural hearing aid fittings.

13 Claims, 2 Drawing Sheets

AUDIO AMPLIFICATION DEVICE WITH VOLUME CONTROL

FIELD OF THE INVENTION

The present invention relates generally to communications and audio equipment. More particularly, the invention relates to audio amplification equipment, including hearing aids, equipped with a user-operable volume control.

BACKGROUND OF THE INVENTION

Audio amplification devices, such as hearing aids are typically manufactured with volume controls to provide users with the ability to adjust the sound level (i.e. loudness) of output from the devices. Many users of hearing aids appreciate the flexibility provided by a volume control. For example, the volume control allows users to turn down the hearing aid volume when exposed to loud sounds, or to turn up the hearing aid volume when they want to hear very quiet sounds. Users may also use the volume control to compensate for auditory fatigue, which may occur in the course of a day.

While some modern hearing aids are equipped with compression amplifiers that map quiet sounds to just above the threshold of audibility and loud sounds to just below the loudness discomfort level, many users still prefer to be in control of the overall loudness of the output produced by their hearing aids. A user-operable volume control allows a user to customize the hearing aid volume to hear different sounds at levels that the user may find desirable or perceive as more comfortable.

However, once a user adjusts the hearing aid volume on a hearing aid, it is typically difficult for that user to quickly return the volume to a specific level (e.g. a volume associated with a pre-determined default gain, which has been established for that hearing aid during fitting). This may be particularly problematic when binaural hearing aids are used. Many bilateral hearing losses are corrected with a binaural hearing aid fitting, to ensure that directional hearing and speech discrimination in noise are optimized. To achieve the best results, the loudness of the amplified signal perceived by each ear is made equal. While a fitter of a user's hearing aid may initially select the proper volume settings to achieve this, it is easy for the user to change these settings. As a result, some of the advantages provided by the binaural fitting may be lost.

SUMMARY OF THE INVENTION

The present invention relates to audio amplification equipment, including hearing aids, and is generally directed to a hearing aid equipped with a user-operable volume control that provides users with the facility to return the hearing aid volume to a specific level after having been adjusted to a different level by the user.

In one broad aspect of the present invention, there is provided a digital hearing aid comprising an electronic module, the electronic module comprising: a microphone for receiving an input acoustic signal; an analog-to-digital converter coupled to the microphone for converting the input acoustic signal to an input digital signal; a processing core for processing the input digital signal to produce an output digital signal; a digital-to-analog converter coupled to the processing core for converting the output digital signal to an output acoustic signal; a receiver coupled to the digital-to-analog converter for delivering the output acoustic signal to a user; a battery compartment adapted to receive a battery for powering the digital hearing aid; and a volume control operable by the user within a range of volume positions; wherein the electronic module is adapted to emit a reference signal when the volume control reaches a pre-determined volume reserve position in the range, after the volume control is moved from a second volume position in the range to the pre-determined volume reserve position.

In another broad aspect of the present invention, there is provided a hearing aid comprising an electronic module, the electronic module comprising: at least one microphone; an amplifier coupled to the at least one microphone to amplify sound therefrom; a receiver coupled to the amplifier to deliver sound therefrom to a user; a battery compartment adapted to receive a battery for powering the hearing aid; and a volume control operable by the user within a range of volume positions; wherein the electronic module is adapted to emit a reference signal when the volume control reaches a pre-determined volume reserve position in the range, after the volume control is moved from a second volume position in the range to the pre-determined volume reserve position.

In one embodiment of the present invention, the reference signal is an audible tone that is produced every time the volume reserve position is reached or crossed, as the position of the volume control is changed by the user.

Accordingly, the present invention permits users to return the hearing aid volume to a specific level more easily.

BRIEF DESCRIPTION OF THE DRAWINGS

These and other features of the present invention will be made apparent from the following description of a preferred embodiment of the invention, with reference to the accompanying drawings, in which.

DETAILED DESCRIPTION OF THE INVENTION

The present invention is generally directed to user-operated controls on communication and audio devices that adjust such devices to a preferred or prescribed operating condition. This condition may be a preferred loudness setting in a cell phone, a preferred loudness balance in a home entertainment system, etc. Furthermore, the user-operated control may be programmed to default automatically to an electronically controlled start-up value, when the device is initially powered or when it is restarted. The user-operated control setting can be changed away from the default setting for a number of reasons over a period of use. The present invention allows the user to easily return the control to the default setting. More specifically, the present invention is directed to a hearing aid equipped with a user-operable volume control that provides a user with the facility to return the hearing aid volume to a specific level after having been adjusted to a different level by the user.

In one preferred embodiment of the invention, the audio device is a hearing aid. The hearing aid produces an audible tone (although another type of distinct signal may be employed) every time a pre-determined volume reserve position is reached, as the user adjusts the hearing aid volume using the volume control. The volume reserve position is associated with a start-up gain, which may be specified during fitting of the hearing aid. Accordingly, a user can return the hearing aid volume to a specific level with ease. Regardless of the position of the volume control at any given time, whether when the hearing aid is first turned on or during the day, the user can always find the volume reserve position associated with the specified start-up gain by adjusting the volume control until the tone is heard.

Even in the case of auditory fatigue, the user can consistently adjust the hearing aid to a preferred loudness, by using the audible tone (or other reference signal as may be employed) as a reference point.

Furthermore, since the invention can be implemented on an individual hearing aid, the present invention may be adapted for use with both monaural and binaural hearing aid fittings. The present invention may be particularly advantageous when used in binaural fittings, as it permits users to restore both hearing aids to the proper binaural balance as may be determined and prescribed at the time of fitting.

Figure 1:
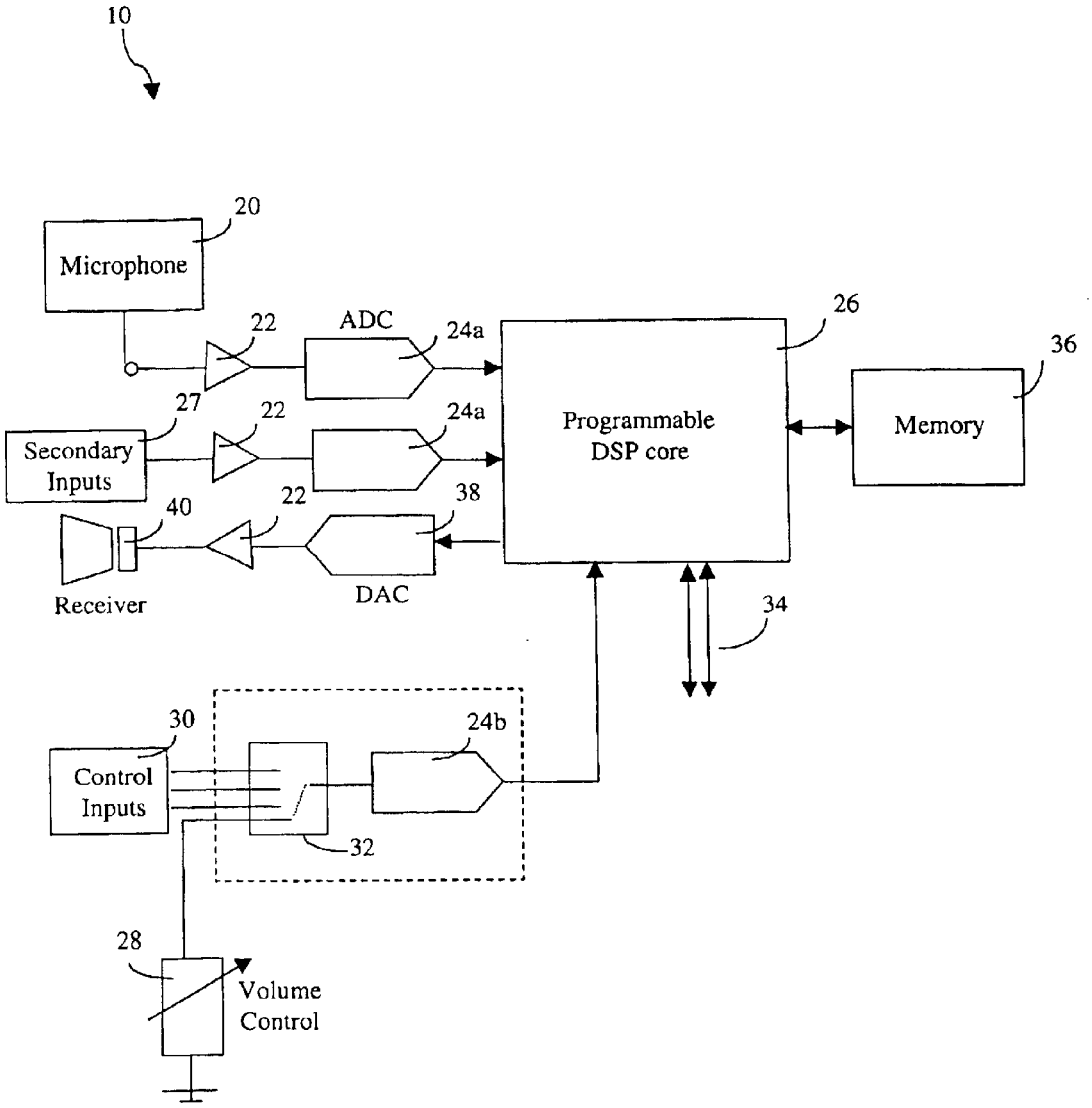
FIG. 1 is a schematic diagram illustrating the components of a hearing aid in an embodiment of the invention.

Referring to FIG. 1, a schematic diagram illustrating the components of a hearing aid in an embodiment of the invention is shown generally as 10.

Hearing aid 10 is a digital hearing aid that includes an electronic module, which comprises a number of components that collectively act to receive sounds or secondary input signals (e.g. magnetic signals) and process them so that these signals can be better heard by the user of hearing aid 10. These components are powered by a battery (i.e. a power source) stored in a battery compartment [not shown] of hearing aid 10. In the processing of received signals, the signals are often amplified for output to the user.

Hearing aid 10 includes one or more microphones 20 for receiving sound and converting the sound to an analog, input acoustic signal. The input acoustic signal is transmitted through a transceiver 22 to an analog-to-digital converter (ADC) 24*a*, which converts the input acoustic signal to an input digital signal for further processing. The input digital signal is then transmitted to a programmable digital signal processing (DSP) core 26. Other inputs 28 may also be received by core 26 through a transceiver 22, and where inputs 28 are analog, through an ADC 24*a*. The secondary inputs 27 may include a telecoil circuit which provides the core with a telecoil input signal. In still other embodiments, the telecoil circuit may replace microphone 20 and serve as a primary signal source.

Hearing aid 10 also includes a variable hearing aid volume control 28, which is operable by the user within a range of volume positions. A signal associated with the current setting or position of volume control 28 is transmitted to core 26 through a low-speed ADC 24*b*. In one implementation of this embodiment of the invention, ADC 24*b* samples the current position of volume control 28 and compares the instantaneous resistance of volume control 28 to a pre-determined resistance value (stored in hearing aid 10 as described in further detail below). When these values are equal, core 26 is programmed to generate and emit a reference signal (e.g. an audible tone) for a selected time period in accordance with the present invention.

Hearing aid 10 may also provide for other control inputs 30 that can be multiplexed with signals from volume control 28 using multiplexer 32.

Volume control 28 may be in the form of a rotating or sliding control, for example, which protrudes from the casing of hearing aid 10. Volume control 28 may also provide volume adjustment either continuously or in discrete steps as the volume control is operated. Preferably, although not necessarily, volume control 28 is equipped with end stops, as volume controls without end stops are not generally preferred by users. Marking indicia on volume control 28 and the casing of hearing aid 10 may be optionally used to visually identify various volume positions, to which the user may adjust volume control 28. These markings are, unfortunately, not visible to the user when the hearing aid is worn on or in the ear. Alternatively, the volume produced by the hearing aid may be adjusted using a remote control device, when the hearing aid is equipped with such a feature.

All signal processing is accomplished digitally in hearing aid 10 through core 26. Digital signal processing generally facilitates complex processing which often cannot be implemented in modern analog hearing aids. Sophisticated feedback prevention techniques may be employed, and better resolution in pitch and loudness shaping may be obtained in digital hearing aids, for example. Adjustments to hearing aid 10 may be made digitally by hooking it up to a computer, for example, through external port interfaces 34.

Hearing aid 10 may be preset to a preferred volume reserve position as required by the user's individual hearing loss before use of hearing aid 10, as may be determined during a fitting, for example. This preferred volume reserve position is used to ensure that normal speech is mapped into the most comfortable listening range of the user. The volume reserve position is associated with a start-up gain, a default measure of how much hearing aid 10 increases the level of sound in this position. A gain value associated with the volume reserve position (e.g. a resistor or voltage value) is stored in a non-volatile memory 36 of hearing aid 10 by core 26. This permits core 26 to detect when volume control 28 has been operated to reach the volume reserve position associated with the stored gain value, even as the volume reserve position is crossed. It will be understood by persons skilled in the art that memory 36 may comprise a number of different memory stores for use by core 26, including volatile and non-volatile memory components.

Core 26 is programmed to generate an audible tone when the volume reserve position associated with the stored gain value is reached, so that even if volume control 28 has been moved from the volume reserve position for any reason, the user is notified when volume control 28 has been returned to the volume reserve position by the sounding of the tone. In this embodiment, the generated tone is added to the digital audio path in producing an output digital signal. The output digital signal is converted to an output acoustic signal by a digital-to-analog converter (DAC) 38, which is then transmitted through an amplifier 22 to a receiver 40 for delivering the output acoustic signal as sound to the user. The tone is amplified to the correct audible level for the specific user's hearing loss, and is perceived by the user when emitted. The tone is added for a selected time. For example, the tone may be added for 1 second, or for more or less than a second. Once the tone ends, the operation of the hearing aid returns to its previous state so that the user is able to hear ambient sounds.

In variant embodiments, the generated tone (or other reference signal) need not be superimposed on the output digital signal as processed by core 26 based on the input signals such that the stream of sounds being heard by the user remains uninterrupted. Furthermore, it will be understood by persons skilled in the art that the generated tone (or other reference signal) may be produced by a component other than core 26, including components that receive and/or generate analog signals. Where analog reference signals are produced, these signals may be superimposed over acoustic signals before delivery to a user without undergoing conversion to and from a digital state.

Core 26 may be programmed to generate and emit different types of audible tones, of different frequencies and loudness levels. Alternatively, the type of alerting signal or tone, its loudness and frequency may be automatically adjusted as a function of the instantaneous loudness level in the listening environment, to ensure that the alerting signal is always audible to the user. Core 26 may be programmed to permit users or fitters to select the type of tone, or some other distinct type of audible signal, if desired. Core 26 may also be programmed to allow users or fitters to temporarily or permanently enable or disable the generation of tones or other reference signals. These actions may be controlled by providing appropriate switches as control inputs (e.g. control inputs 30), for example. Reference signal characteristics including the selected reference signal type, and a frequency and loudness level associated with the selected reference signal, for example, may also be stored by core 26 in memory 36.

The use of audible signals to indicate when the volume reserve position has been reached allows users of hearing aid 10 to make volume adjustments while wearing hearing aid 10, and while hearing aid 10 is in operation. The user need not visually examine or rely upon marking indicia on volume control 28 or the casing of hearing aid 10 to return volume control 28 to the pre-determined volume reserve position.

In variant embodiments of the invention, other reference signals other than audible signals may be used to indicate that the volume reserve position has been reached. For example, hearing aid 10 may be equipped with visual indicators, tactile or pressure indicators, or other sensory cues that serve to notify the user when the volume reserve position has been reached.

Hearing aid 10 may be adapted to permit operation of the hearing aid 10 within a volume control range of volume positions (e.g. 10 dB or 30 dB), with the current position being controlled by the user through volume control 28. However, hearing aid 10 may also be adapted to permit fitters to disable manual volume control by the user, if desired. The volume reserve position is independent of the absolute volume control range, but the amount of loudness change above or below this position will generally be larger for larger volume control ranges. The volume reserve position is situated between the ends of the volume control range, but preferably not at the ends, to give users the flexibility of adjusting the volume both above and below the pre-determined volume reserve position, which may be used as a reference for desired user adjustments.

The volume reserve position may be preset as a default position based on the volume range. For example, if the volume range is 30 dB, the volume reserve position may be chosen to correspond with a 10 dB gain, and if the volume range is 10 dB, the volume reserve position may be chosen to correspond with a 3 dB gain; this may then be represented as position "3" as marked on a typical behind-the-ear (BTE) hearing aids. In this manner, volume control 28 need not be active during fitting.

Alternatively, volume control 28 may be configured in actual operation, while active during fitting. Core 26 is programmed to detect a position of volume control 28 as identified by the fitter (e.g. through control inputs 30), and to store this position as the volume reserve position.

Core 26 is controlled by software that is programmed to perform the functions as described above in this embodiment of the invention. Core 26 may be further controlled by fitting software, which allows fitters to enable and disable manual volume control, to select a desired volume control range, and to select a gain value with which the volume reserve position is to be associated, for example. The selected gain value is then stored in memory 36 of hearing aid 10. The software also facilitates selection and setting of various reference signal characteristics including, for example, the type of reference signal, and where the reference signal is an audible signal, the frequency and loudness of the reference signal.

Figure 2:
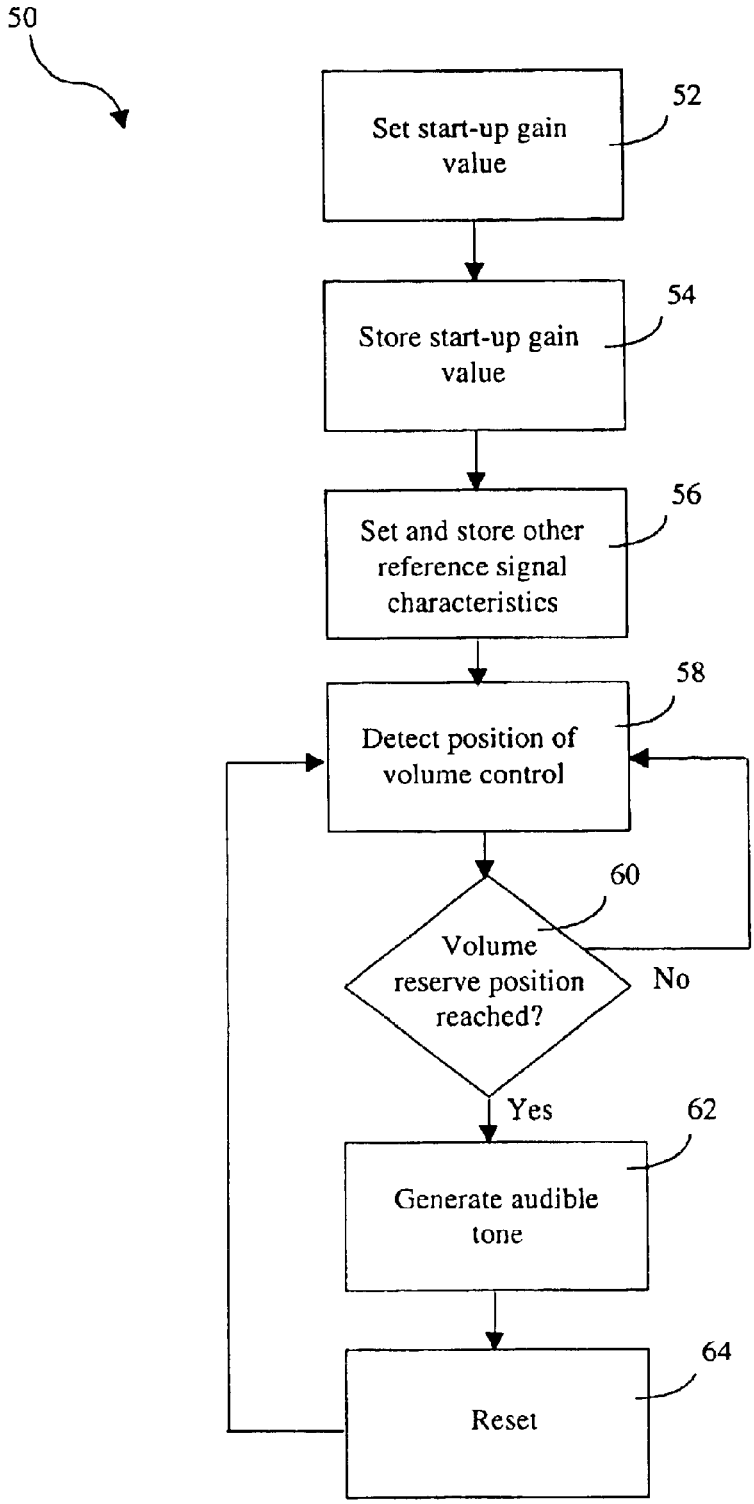
FIG. 2 is a flowchart illustrating steps in a method of fitting and operating the hearing aid in accordance with an embodiment of the invention.

Referring to FIG. 2, a flowchart illustrating steps in a method of fitting and operating a hearing aid in accordance with an embodiment of the invention is shown generally as 50.

At step 52, a fitter sets the start-up gain value to be associated with the volume reserve position in the hearing aid (e.g. hearing aid 10 of FIG. 1).

At step 54, this gain value is stored by a processing core (e.g. core 26 of FIG. 1) in a non-volatile store of a memory (e.g. memory 36 of FIG. 1) of the hearing aid.

At step 56, other reference signal characteristics may optionally be set and stored in memory, or default values may be used. Such reference signal characteristics may include the type of reference signal, and in the case of audible signals, the frequency and loudness level of the reference signal, for example.

At step 58, the position of the volume control (e.g. volume control 28 of hearing aid 10) is detected.

At step 60, a determination is made if the volume reserve position, based on the gain value stored at step 54, has been reached or crossed as a result of the volume control being adjusted to (or past) the volume reserve position from a second volume position by a user. If not, the flow of method steps proceeds back to step 58, where the position of the volume control continues to be monitored. Otherwise, the flow of method steps proceeds to step 62.

At step 62, a reference signal is generated and emitted. In this embodiment, the reference signal is in the form of an audible tone, which is made audible to the user through a receiver (e.g. receiver 40 of FIG. 1), indicating that the volume reserve position has been reached.

At step 64, a reset may be performed, before the flow of method steps proceeds back to step 58 to continue monitoring the position of the volume control. In the case of an audible signal, for example, the reset may be used to prevent a continuous tone from being sounded if the volume control is left precisely at the volume reserve position by the user. Once the volume control is adjusted to a second volume position different from the volume reserve position, the tone generating feature is re-activated.

While embodiments of the present invention have been described in an implementation where hearing aid 10 comprises an electronic module controlled by software, it will be understood by persons skilled in the art that other implementations are possible, including systems implemented strictly in hardware, for example.

Furthermore, while embodiments of the present invention have been described with respect to digital hearing aids, it will be understood by persons skilled in the art that the present invention may also be implemented with respect to conventional analog or programmable analog hearing aids. With respect to these other types of hearing aids, an amplifier is typically used to amplify signals received through one or more microphones or telecoil of the hearing aid, rather than a DSP core. In variant embodiments of the invention, electronic components may be used to detect when the volume control reaches a pre-determined volume reserve position (e.g. associated with a gain value "hard-wired" in a circuit). The components are adapted to emit the reference signal when the volume control reaches the volume reserve position.

The present invention has been described with regard to a number of embodiments. However, it will be understood by persons skilled in the art that other variants and modifications may be made without departing from the scope of the invention as defined in the claims appended hereto.

What is claimed is:

1. An audio amplification device comprising an electronic module, said electronic-module comprising:

(a) a microphone for receiving sound and converting said sound to an input acoustic signal;

(b) an analog-to-digital converter coupled to said microphone for converting said input acoustic signal to an input digital signal;

(c) a processing core for processing said input digital signal to produce an output digital signal;

(d) a digital-to-analog converter coupled to said processing core for converting said output digital signal to an output acoustic signal;

(e) a receiver coupled to said digital-to-analog converter for delivering said output acoustic signal to a user;

(f) a battery compartment adapted to receive a batter for powering said amplification device; and (g) a volume control operable by said user within a range of volume positions;

wherein said electronic module is adapted to emit a reference signal when said volume control reaches a predetermined volume reserve position in said range, after said volume control is moved from a second volume position in said range to said predetermined volume reserve position.

2. The audio amplification device of claim 1, wherein the device is a hearing aid.

3. The audio amplification device of claim 1, wherein said volume control is coupled to said processing core, and wherein said processing core is adapted to detect when said volume control reaches said volume reserve position and to generate said reference signal when said volume reserve position is reached.

4. The audio amplification device of claim 3, said reference signal being audible to said user through said receiver when emitted.

5. The audio amplification device of claim 4, wherein said processing core is adapted to produce an output digital signal in which said reference signal has been superimposed thereon.

6. The audio amplification device of claim 4, wherein said processing core is adapted to amplify said reference signal generated thereby.

7. The audio amplification device of claim 3, further comprising a memory in which a plurality of reference signal characteristics are stored.

8. The audio amplification device of claim 7, wherein said reference signal characteristics include a gain value associated with said volume reserve position, and wherein said gain value is used by said processing core to detect when said volume control reaches said volume reserve position.

9. The audio amplification device of claim 8, wherein said processing core is adapted to store said gain value as specified during fitting of said amplification device.

10. The audio amplification device of claim 7, wherein said reference signal characteristics further includes a reference signal type.

11. The audio amplification device of claim 10, said reference signal being audible to said user through said receiver when emitted, and wherein said reference signal characteristics further includes at least one of: a type of audible signal, a frequency associated with said reference signal, and a loudness level associated with said reference signal.

12. A hearing aid comprising an electronic module, said electronic module comprising:

(a) at least one microphone;

(b) an amplifier coupled to said at least one microphone to amplify sound received thereby;

(c) a receiver coupled to said amplifier to deliver sound therefrom to a user;

(d) a battery compartment adapted to receive a battery for powering said hearing aid; and (e) a volume control operable by said user within a range of volume positions;

wherein said electronic module is adapted to emit a reference signal when said volume control reaches a predetermined volume reserve position in said range, after said volume control is moved from a second volume position in said range to said pre-determined volume reserve position.

13. The hearing aid of claim 11, said signal being audible to said user through said receiver.

* * * * *